US005655248A

United States Patent [19]

Kieson et al.

[11] Patent Number: 5,655,248

[45] Date of Patent: Aug. 12, 1997

[54] WIPER FOR WRINGER MOP WITH ROLLERS

[75] Inventors: Gregory I. Kieson, Haddonfield; Anthony Lalli, Medford, both of N.J.

[73] Assignee: New Knight Inc., Paoli, Pa.

[21] Appl. No.: 730,626

[22] Filed: Oct. 21, 1996

Related U.S. Application Data

[60] Provisional application No. 60/014,327, Mar. 29, 1996, and provisional application No. 60/024, 550, Aug. 26, 1996.

[51] Int. Cl. [6] ..... A47L 13/12; A47L 13/144

[52] U.S. Cl. ..... 15/119.2; 15/121; 15/245; 15/246

[58] Field of Search ..... 15/116.2, 119.2, 15/121, 245, 246

[56] References Cited

U.S. PATENT DOCUMENTS

| | | | |
|---|---|---|---|
| 4,491,998 | 1/1985 | Wilson et al. | 15/119.2 |
| 4,604,767 | 8/1986 | Burkhart et al. | 15/119.2 |
| 4,654,920 | 4/1987 | O'Neil, Jr. et al. | 15/119.2 |
| 5,097,561 | 3/1992 | Torres | 15/116.2 X |

FOREIGN PATENT DOCUMENTS

| | | | |
|---|---|---|---|
| 202357 | 7/1956 | Australia | 15/116.2 |
| 724871 | 2/1955 | United Kingdom | 15/116.2 |

*Primary Examiner*—Mark Spisich

*Attorney, Agent, or Firm*—Dann, Dorfman, Herrell and Skillman, P.C.

[57] ABSTRACT

Apparatus is provided for cleaning surfaces such as glass. A roller wringer mop having a sponge head uses cleaning fluid to clean a surface. To wring the cleaning fluid from the sponge head, an operator displaces the sponge head between two parallel roller segments. A wiper connected to the mop head wipes residual cleaning fluid from the surface that has been cleaned, and is connected to the mop head so as to avoid interfering with the wringing action of the sponge head.

18 Claims, 8 Drawing Sheets

WIPER FOR WRINGER MOP WITH ROLLERS

CROSS-REFERENCE TO RELATED APPLICATIONS

Priority is claimed herein under 35 U.S.C. §119(e) in the subject matter disclosed in each of U.S. Provisional Application No. 60/014,327, filed Mar. 29, 1996; and U.S. Provisional Application No. 60/024,550, filed Aug. 26, 1996. Each of the aforementioned provisional applications is hereby incorporated herein by reference.

FIELD OF THE INVENTION

The present invention relates to wipers for cleaning surfaces such as glass. Specifically, the present invention relates to a wiper that is operable with a wringer mop that utilizes rollers. More specifically, the present invention relates to a wiper that is operable with the rollers of a roller mop without impeding the wringing of the mop.

BACKGROUND OF THE INVENTION

Wringer mops that utilize rollers are well known in the prior art. Typically, the known roller mops incorporate a mop head connected to the end of a handle. The mop head has a pair of parallel rows of rollers spaced apart from one another. A draw bar passes through the handle and extends within the mop head. The draw bar is connected at one end to an operator on the handle. The other end of the draw bar is connected to a sponge head. The wringing operation is initiated by activating the operator. The operator causes the draw bar to pull the sponge head between the parallel rows of rollers, thereby wringing the sponge of the sponge head. Known roller mops are adequate for cleaning surfaces such as floors, but are not suitable for cleaning transparent surfaces such as windows.

Therefore, it is an object of the present invention to provide a mop that incorporates the advantages of a wringer mop that utilizes rollers, with a wiper that is able to remove cleaning fluid from a cleaning surface.

It is a further object of the present invention to provide a wiper that is removably mountable with the cylindrical rollers of a wringer mop, so that the rollers can operate to wring the sponge head when the wiper is mounted on the rollers.

It is a further object of the present invention to provide a wiper that can be removably mounted upon a variety of wringer mops having cylindrical rollers of varying diameter.

It is a further object of the present invention to provide a wiper that is pivotally mounted on a wringer mop, pivoting between an extended position and a retracted position in response to actuation of an operator to wring the sponge head.

SUMMARY OF THE INVENTION

With the foregoing in mind, the present invention provides a novel wiper that is removably mountable upon the cylindrical rollers of a wringer mop.

The wiper of the present invention is used in connection with a wringer mop having an elongated handle and two rows of cylindrical rollers for wringing a sponge head. The wiper comprises a body, a wiper blade connected to the body and a roller clamp. The roller clamp has a pair of parallel sides projecting from the surface of the body. The sides are spaced from one another forming a saddle for receiving a roller of the wringer mop. The sides project from the body a height at least as great as the radius of the roller, and the distance between the sides correlates to the diameter of the roller.

Additionally, the present invention provides a wringer mop with a wiper, comprising an elongated handle to which a mop head is connected. The mop head comprises two parallel axles spaced apart from one another onto which cylindrical rollers are rotatably mounted. A draw bar extends from the mop head and is connectable with a sponge head. The sponge head comprises a sponge and a sponge bracket connected to the sponge. The draw bar is connected to the sponge bracket so that displacement of the draw bar in one direction draws the sponge head through the rollers to wring the sponge.

A wiper connected to the mop head comprises a body, a wiper blade connected to the body, and a roller clamp. The roller clamp has a pair of parallel sides projecting from the surface of the body. The sides are spaced from one another forming a saddle for receiving a roller of the wringer mop. The sides project from the body a height at least as great as the radius of the roller, and the distance between the sides correlates to the diameter of the roller.

A second embodiment of a wiper comprises a cylindrical base mounted on an axle of the mop head on which the roller segments are mounted. Two arms project from the cylindrical base and are connected remote from the cylindrical base by a wiper blade holder. The wiper blade holder is fixedly connected to the wiper blade holder. By pivoting an actuator of the mop, the sponge head is displaced relative to the cylindrical base, thereby pivoting the wiper.

BRIEF DESCRIPTION OF THE DRAWINGS

All of the objects of the present invention are more fully set forth hereinafter with reference to the accompanying drawings, wherein.

Figure 6:
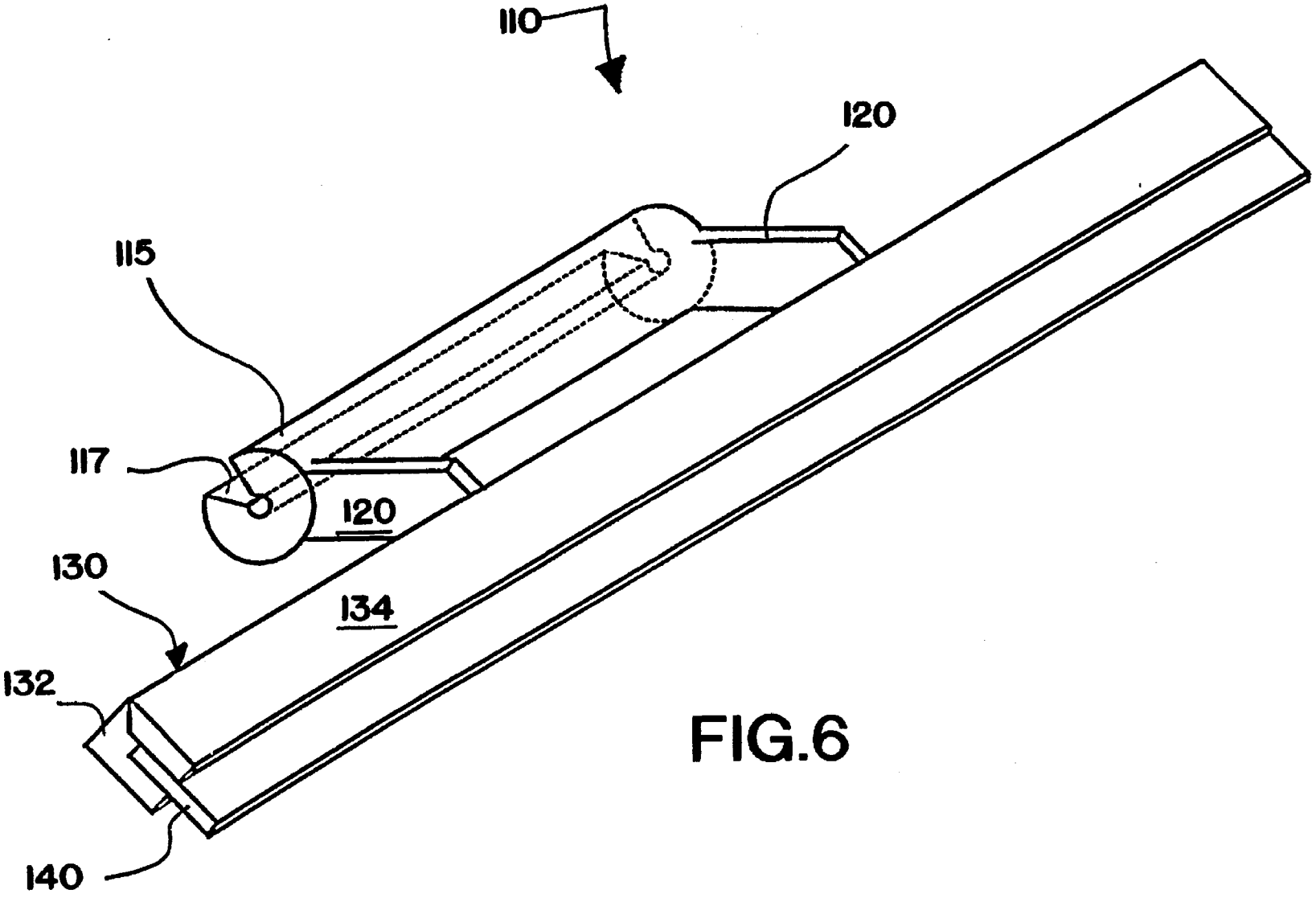
FIG. 6 is a perspective view of a second embodiment of a wiper manifesting aspects of the invention.

FIG. *7a* is a front elevational view of the wiper shown in FIG. 6 mounted on a wringer mop, with the wiper shown in a retracted position.

FIG. *7b* is a front elevational view of the wiper shown in FIG. 6 mounted on a wringer mop, with the wiper shown in a extended position.

Figure 8:
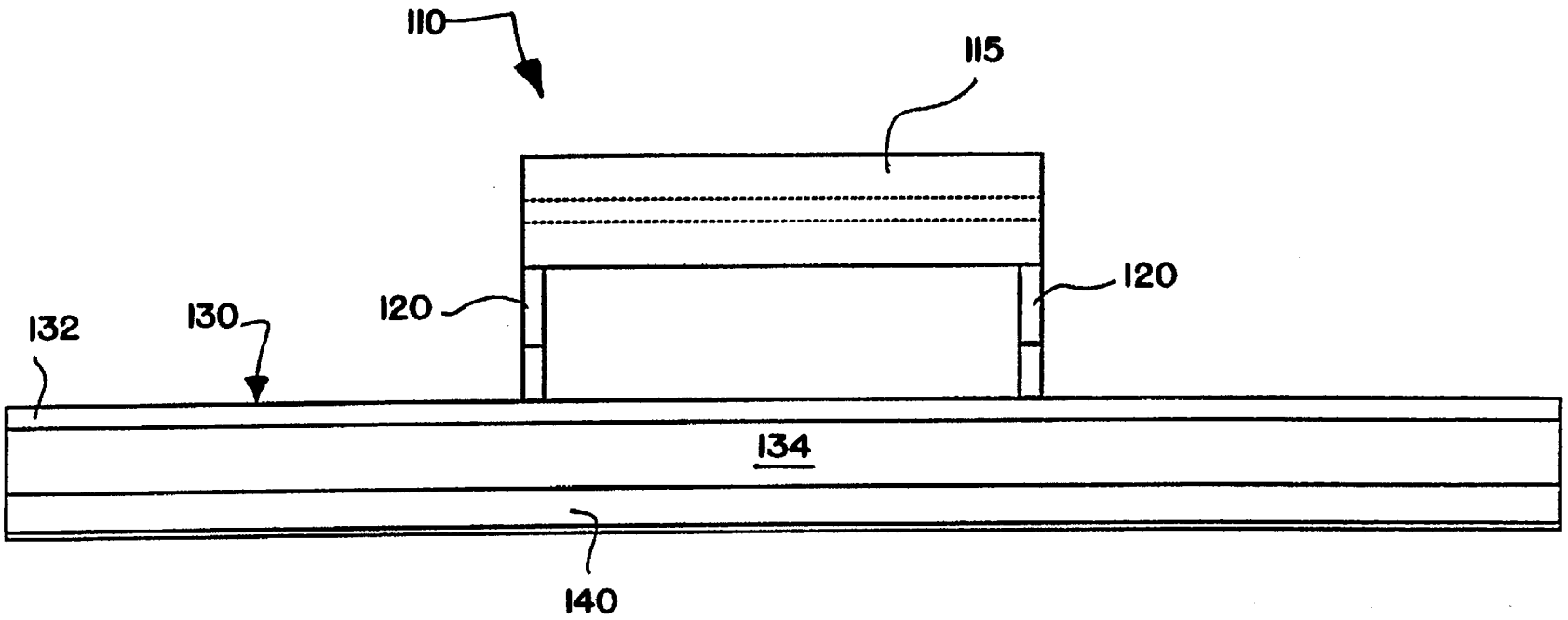

FIG. 8 is a top elevational view of the wiper shown in FIG. 6.

DETAILED DESCRIPTION OF THE PREFERRED EMBODIMENTS

Figure 1:
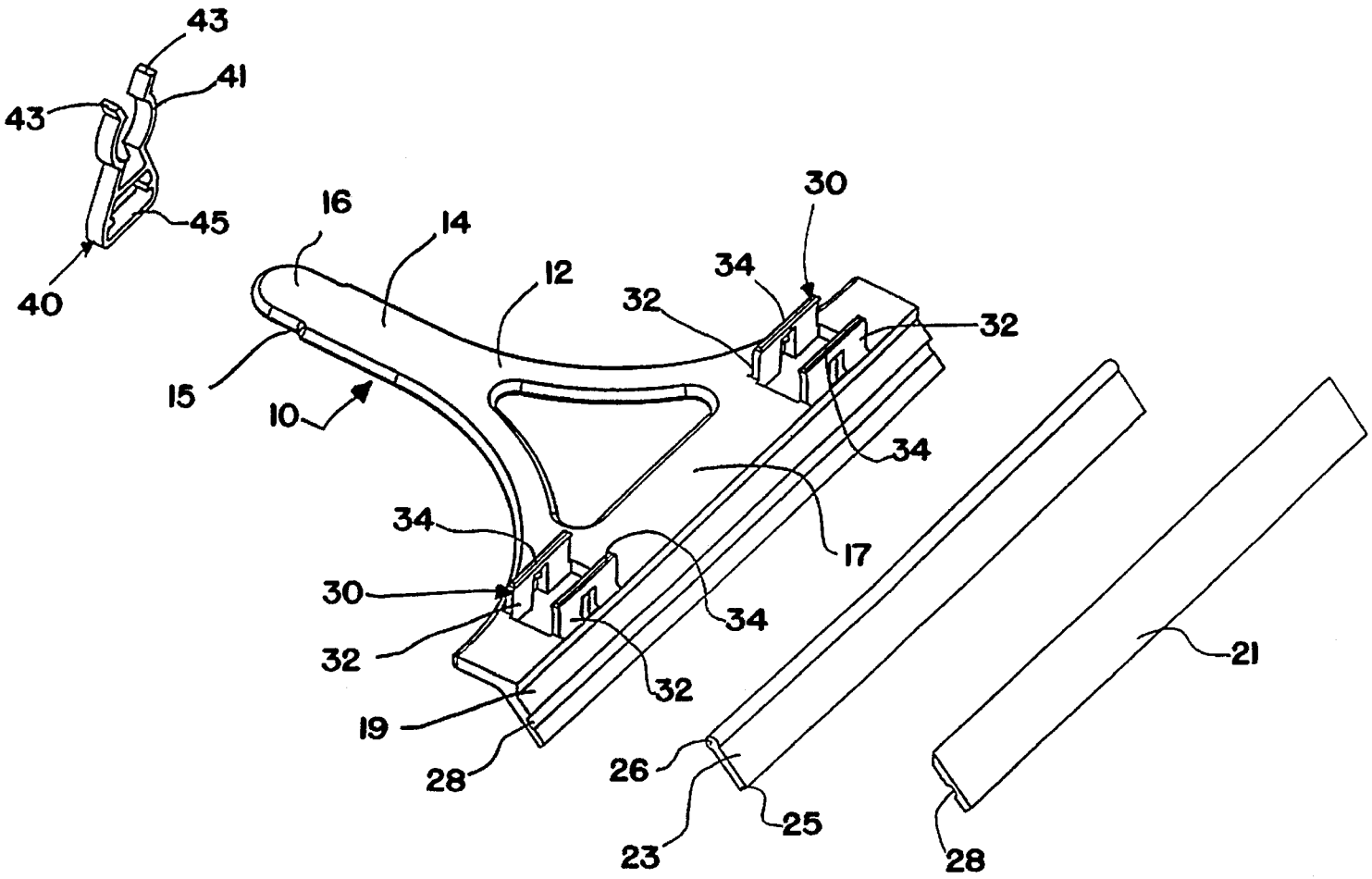
FIG. 1 is an exploded perspective view of a wiper manifesting aspects of the invention.
Figure 2:
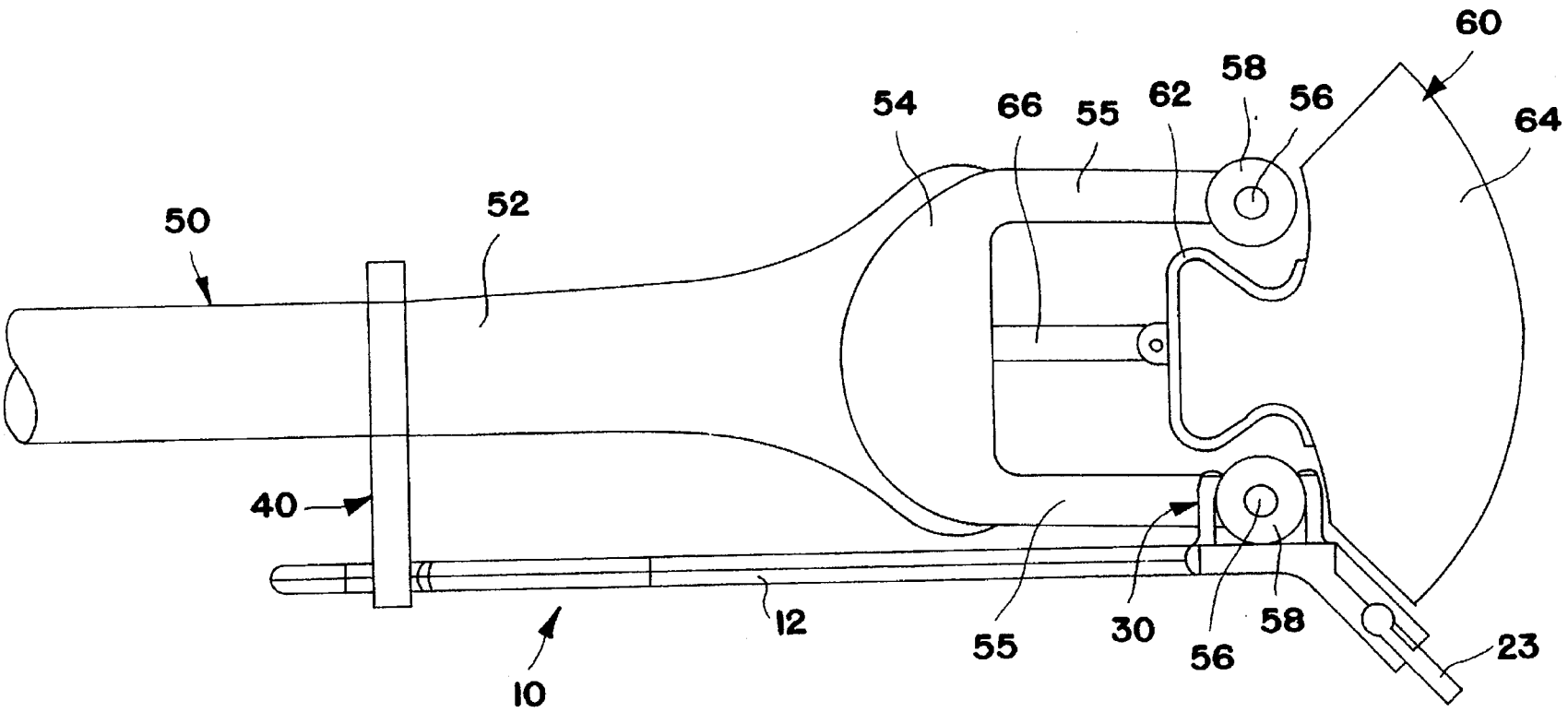
FIG. 2 is a side view of the wiper illustrated in FIG. 1 mounted on a wringer mop, with the handle of the wringer mop being broken away.

Referring now to the drawings in general and to FIGS. 1 and 2 more specifically, a wiper 10 that is removably mountable upon a wringer mop 50 is shown.

Referring to FIG. 2, the details of the wringer mop are more clearly illustrated. The wringer mop 50 has an elongated handle 52 that is preferably tubular. A mop head 54 is connected to one end of the handle 52. The mop head 54 includes a pair of arms 55 that straddle a sponge head 60. An axle 56 is connected to the end of each arm 55. The axles 56 are parallel and spaced apart from one another. A series of cylindrical roller segments 58 are rotatably mounted upon the axles 56. A draw bar 66 extends from the mop head and is pivotally and releasably connectable with the sponge head 60. The sponge head 60 includes a sponge 64 and sponge bracket 62. To wring the sponge 64, the draw bar 66 displaces the sponge head 60. From the perspective of FIG. 2, displacing the draw bar 66 from right to left draws the sponge head 60 between the rollers 58.

As shown in FIG. 2, a wiper 10 is mounted on the wringer mop 50. The wiper 10 may be fixedly connected to the mop handle 52 and mop head 54. However, in the present instance, the wiper 10 is removably mounted to the wringer mop by using a pair of roller clamps 30 and a pole clip 40. The roller clips 30 snap over rollers 58 and straddle the rollers, thereby frictionally engaging the rollers. Additional support is provided by the pole clip 40, which snaps over the mop handle 52, frictionally engaging the mop handle.

The details of the wiper 10 are more clearly illustrated in FIGS. 1 through 5. The wiper comprises a body 12, at least one roller clamp 30, a wiper blade 23, and a pole clip 40. The body 12 is essentially T-shaped comprising a handle and a transverse head having a surface 17 adapted to confront the roller elements 58. The end of the wiper handle 14 remote from the wiper head surface 17 narrows to form a tongue 16 for receipt of the pole clip 40. The pole clip 40 has a slot 45 for receiving the tongue 16. In the present instance, the wiper handle 14 also includes two shoulders 15 on either side of the tongue 16. The pole clip 40 is connected to the wiper handle 14 by sliding the tongue 16 into the slot 45 until the pole clip abuts the shoulders 15. In the present instance, the pole clip 40 is removably connectable with the wiper handle; however, the pole clip may alternatively be fixedly connected to the wiper handle 14.

The pole clip further includes a flexible split collar 41 that is removably connectable with the mop handle 52 to anchor the wiper 10 onto the wringer mop 50 (see also FIG. 2). The opening in the split collar 41 flares outwardly providing two release tabs 43. In its relaxed state, the opening in the split collar 41 is smaller than the diameter of the mop handle. By forcing the release tabs 43 away from one another, the opening of the split collar 41 can be enlarged so that the opening is larger than the diameter of the mop handle 52. After inserting the mop handle into the split collar 41, the force applied to the release tabs 43 is removed and the split collar returns to approximately its relaxed state thereby frictionally gripping the mop handle 52.

In addition to the pole clip, the wiper further comprises at least one roller clamp 30 for removably connecting the wiper 10 to the rollers 58 of the wringer mop 50. In the present instance, the wiper includes a pair of roller clamps 30. Each roller clamp comprises a pair of parallel sides projecting from the surface 17 of the wiper head. The sides are spaced apart from one another forming a saddle for receiving one of the rollers 58 of the wringer mop 50, as shown in FIG. 2.

Figure 3:
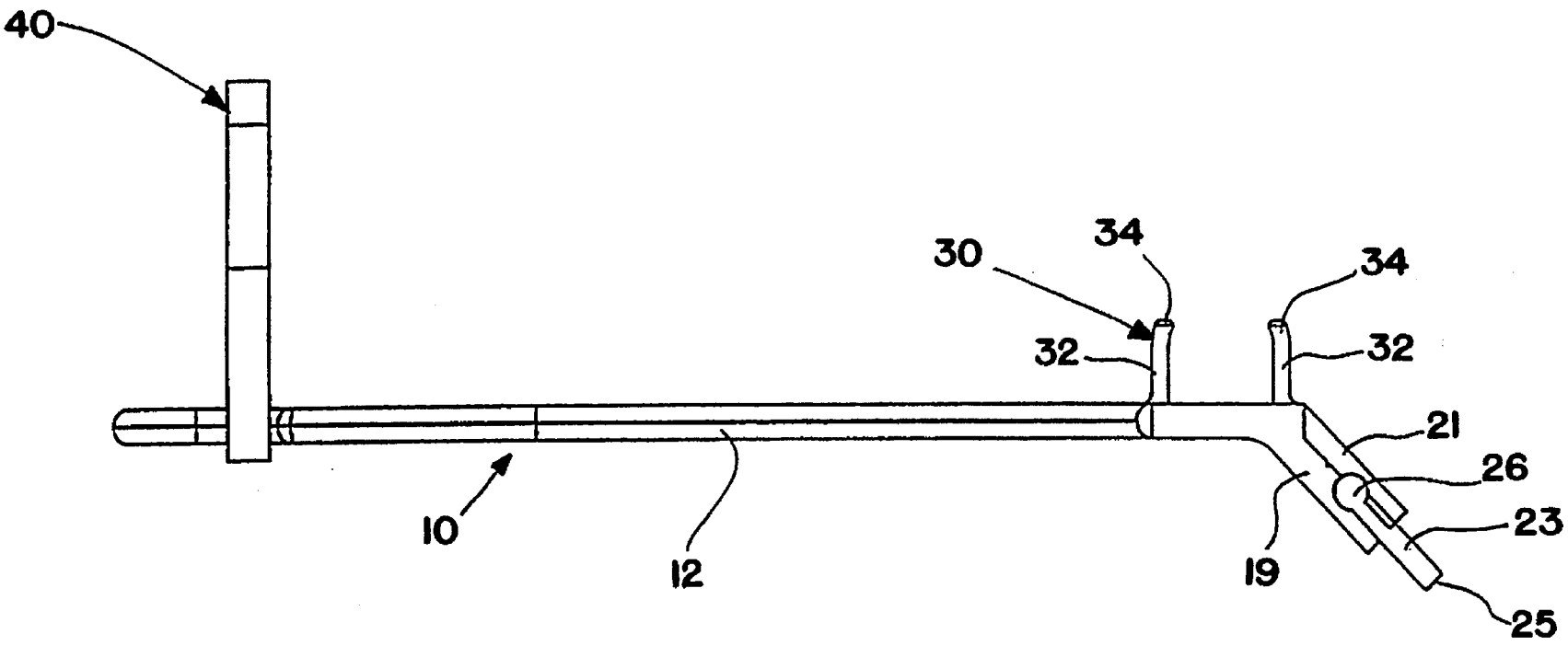
FIG. 3 is a side view of the wiper illustrated in FIG. 1.
Figure 4:
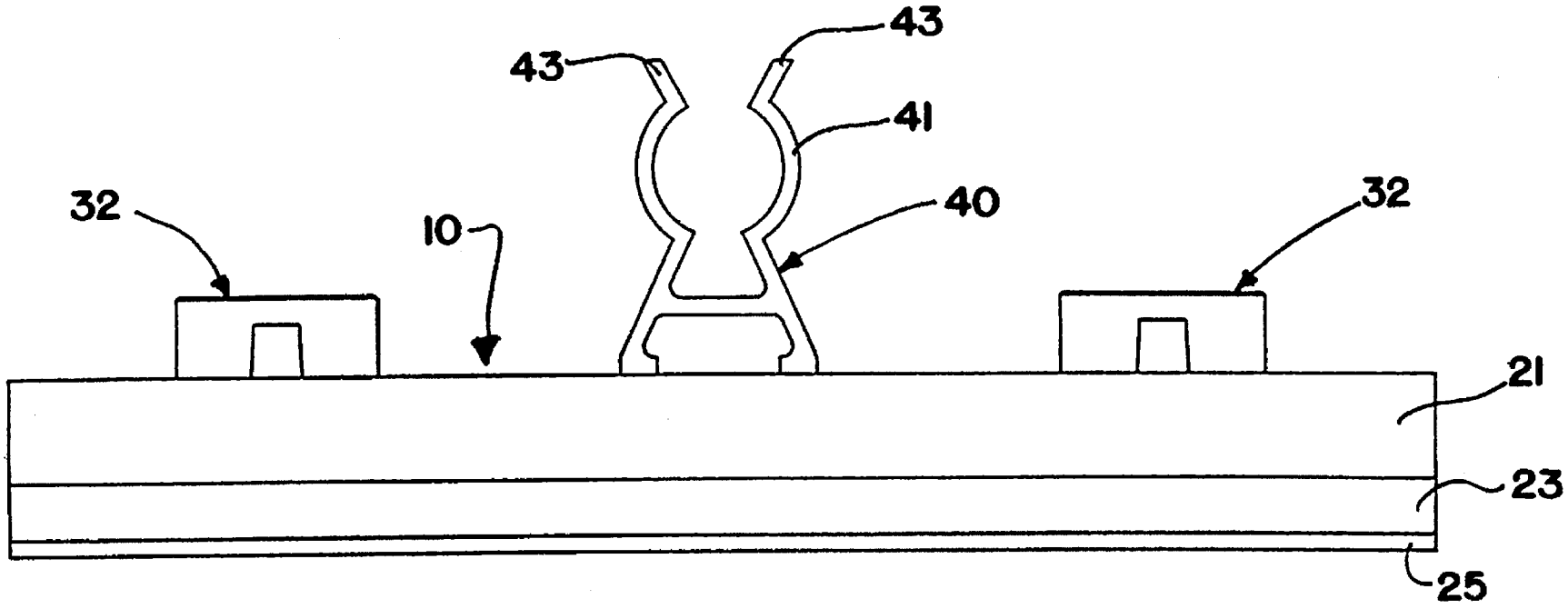
FIG. 4 is a top elevational view of the wiper shown in FIG. 1.

Each of the sides 32 further comprises a flexible gripper portion 34. The gripper portions 34 of each roller clamp 30 oppose one another and angle toward one another so that the distance between the gripper portions 34 is less than the distance between the sides 32 adjacent the surface of the wiper head 17. The correlation of the spacing between the sides to the diameter of the roller elements is such that the distance between the gripper portions 34 is less than the diameter of the cylindrical rollers 58 of the wringer mop 50. The gripper portions flex outwardly so that the roller clamp 30 can snap over at least one of the cylindrical rollers 58 to frictionally engage the roller. As illustrated in FIGS. 2 and 3, the gripper portions of the present embodiment curve inwardly. Alternatively, the gripper portions may taper inwardly.

As the distance between the sides increases, it becomes easier to connect the roller clamps 30 onto the rollers 58. However, as the distance between the rollers increases, the connection between the roller and the roller clamp weakens. In the present instance, the distance between the sides 32 adjacent the surface 17 of the wiper head is approximately ⅝". Additionally, it has been found that the roller clamps 30 are connectable with the different diameter rollers of most commercially available wringer mops if the distance between the gripper portions 34 is approximately 0.590".

Figure 5:
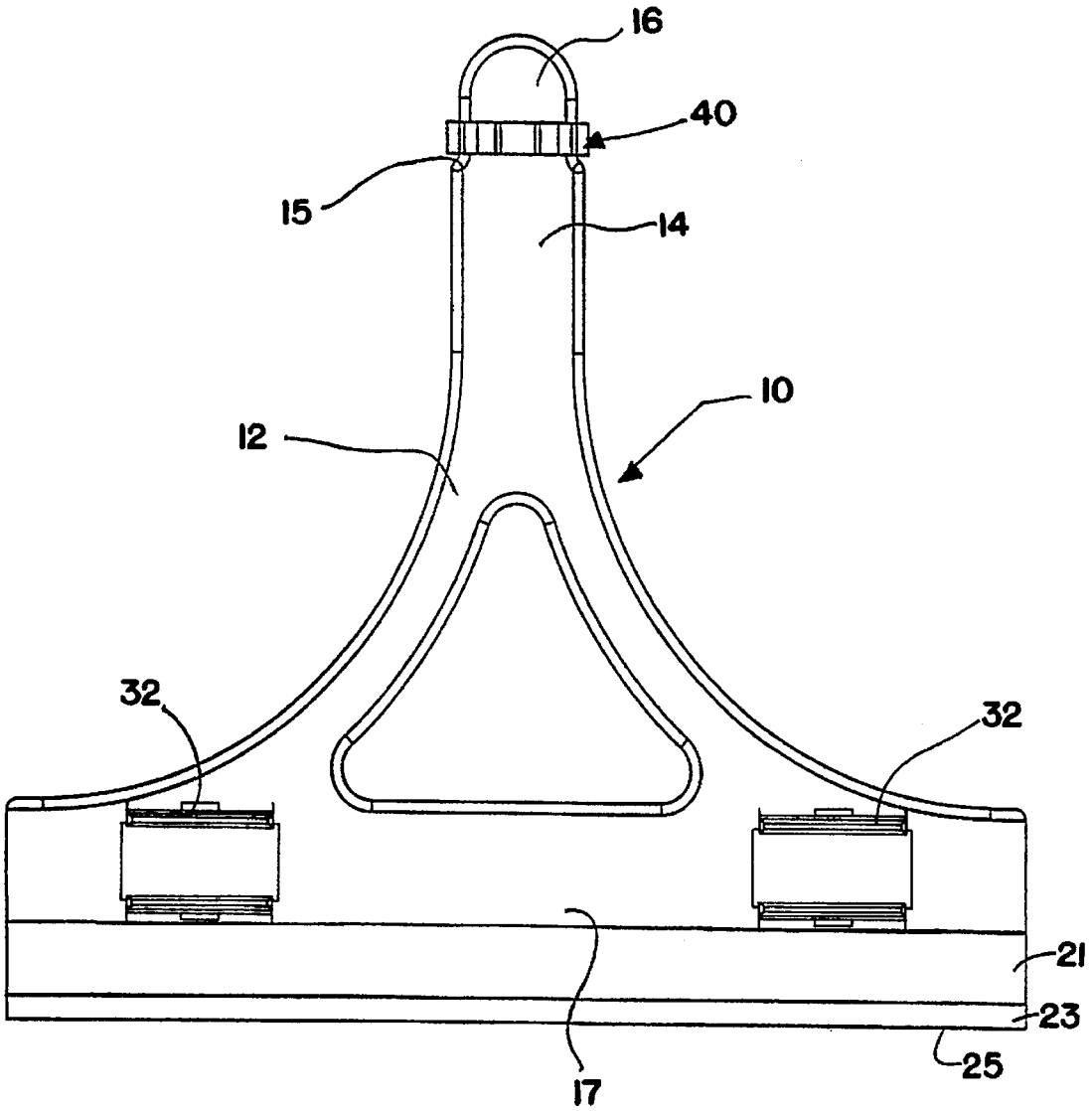
FIG. 5 is a front elevational view of the wiper shown in FIG. 1.

As previously noted, the wiper 10 preferably includes a pair of roller clamps 30. As shown in FIGS. 1 and 5, the roller clamps are aligned so that the segments of the roller elements engaged by the two roller clamps are axially aligned. Because the roller elements comprise a series of aligned segments, clamping the wiper 10 onto two spaced-apart segments does not adversely affect the wringing action provided by the remaining segments.

As illustrated in FIGS. 1 and 3, a wiper support 19 extends from the wiper head 17, forming an angle with the surface of the wiper head. The wiper support 19 forms a backing plate to support a wiper blade 23. The wiper blade is a generally flat resilient flexible strip having two elongated parallel edges. The first edge 25 is straight providing an edge that is suitable to perform a wiping operation. The second edge 26 flares outwardly providing a bulbous edge that is received by a groove 28 in the wiper support 19.

The wiper blade 23 is held in place against the wiper support 19 by a plate 21 that is placed over the bulbous edge 26 of the wiper blade and connected to the wiper support 19. The plate 21 also has a groove 28 for receiving the bulbous edge 26 of the wiper blade. In this way, the plate 21 and the wiper support 19 maintain the wiper blade in position by engaging the bulbous edge 26 and compressing a portion of the wiper blade between the plate and the wiper support. Preferably, the wiper blade 23 is maintained in position so that the wiper blade is parallel to the sides 32 of the roller clamps 30 and at an angle to the surface 17 of the wiper head. In the present instance, the angle between the wiper head surface and both the wiper blades 23 and the wiper support is approximately 135°. This angle provides sufficient clearance between the sponge 64 and the wiper plate 21. This angle also allows the wiper blade to contact the surface being cleaned at an appropriate angle when the angle between the mop and the surface being cleaned is approximately 25°–45°, which is the typical range of angles for most operators.

Figure 7A:
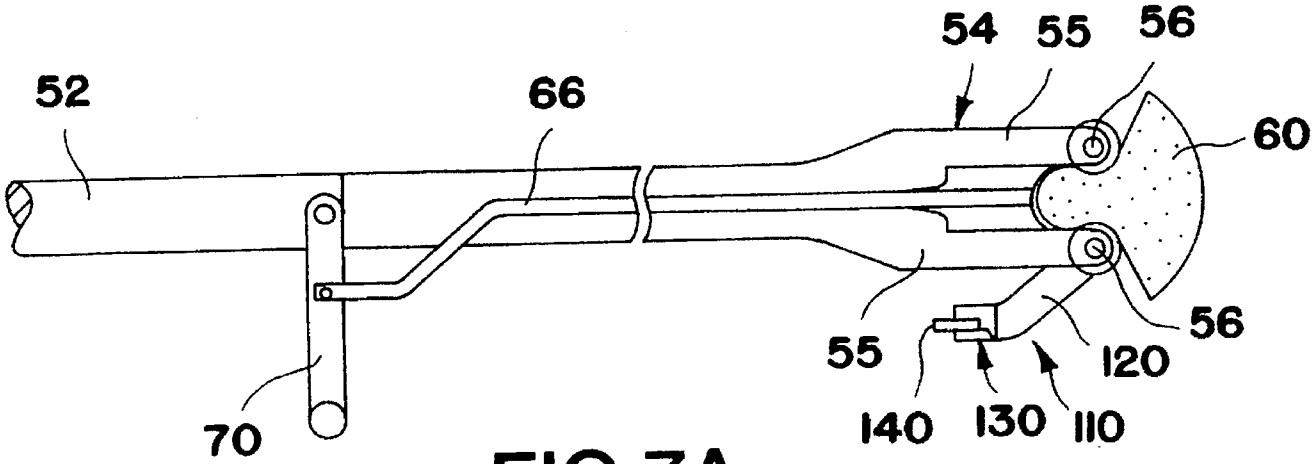
Figure 7B:
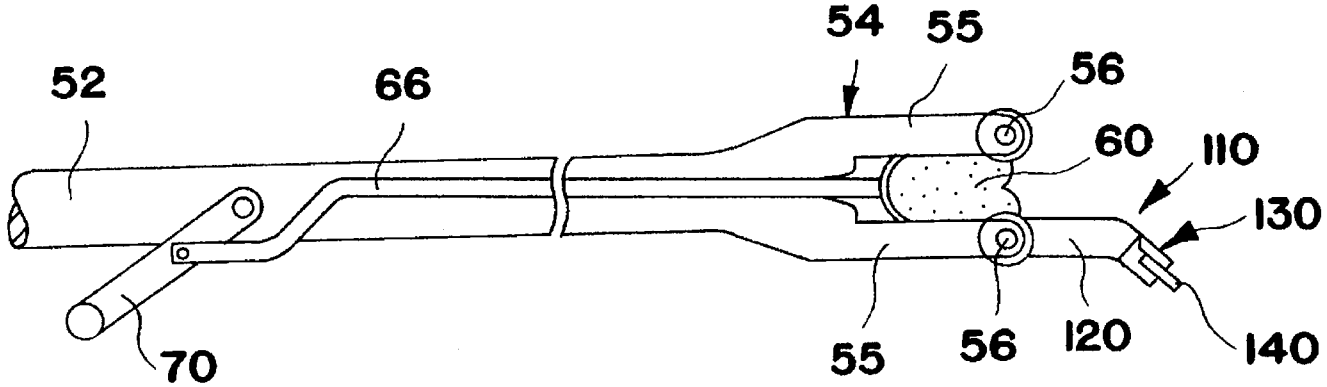

A second embodiment for a wiper 110 operable in connection with the wringer mop 50 is illustrated in FIGS. 6–8. The numbers designating the various parts of the wringer mop in FIGS. 1–5 are used to designate the same parts in FIGS. 6–8.

The second embodiment of the wiper 110 is pivotally connected to the axles 56 of the mop head 54 on which the roller segments 58 are mounted. The wiper 110 pivots between two positions: an extended position illustrated in FIG. **7*b*, and a retracted position as illustrated in FIG. 7*a*. In the extended position, the wiper 110 is operable to wipe the cleaning fluid off of a surface such as a window. In the retracted position, the wiper 110 pivots away from the sponge head 60** so that the sponge head can be used to apply cleaning fluid to a surface such as a window and agitate the cleaning fluid to loosen any dirt on the window.

The wiper 110 includes a pair of parallel spaced-apart arms 120 connected to a rigid wiper blade holder 130. The arms are connected to a cylindrical base 115. The cylindrical base 115 is rotatably mounted on one of the axles 56 of the mop head 54. The cylindrical base 115 can be provided with an orifice extending through the base, so that the base can be mounted onto the axle by sliding the base over the end of the axle. However, in the present instance, the base 115 is provided with a socket 117 that extends along the length of the base. The socket 117 snaps over one of the axles 56 to engage the axle. The diameter of the cylindrical base 115 is approximately the same as the diameter of the roller segments 58 so that the cylindrical base 115 confronts the sponge head 60 when the wiper 110 is mounted on the axles 56 of the mop head 54.

The arms 120 project from the surface of the cylindrical base 115, generally perpendicular to the longitudinal axis of the base and are generally parallel and spaced apart from one another. Each arm curves having an elbow as shown in FIGS. *7a* & *7b*. The end of each arm 120 remote from the cylindrical base 115 is fixedly connected to the wiper blade holder 130.

The wiper blade holder 130 supports an elongated flexible wiper blade 140. In the present instance, the wiper blade 140 is made of rubber. The wiper holder 130 is of two-piece constructions, including a blade support 132 and a retention plate 134. The wiper blade 140 is sandwiched between the blade support 132 and the retention plate 134. The retention plate 134 is then fixedly connected to the blade support 132 to hold the wiper blade 140 in position on the wiper blade holder 130.

The pivoting of the wiper 110 corresponds to the wringing of the sponge head 60, which is controlled by the draw bar 66. As shown in FIGS. *7a*, and *7b*, the draw bar is pivotally connected to a wringer lever 70, which is pivotally connected to the handle 52. When the wringer lever is in the cleaning position as shown in FIG. *7a*, the sponge head 60 is in a retracted position so that the sponge head is operable to clean a surface. In this position, the wiper 110 is retracted away from the sponge head. By pivoting the wringer lever 70 away from the mop head 54 to a wringing position, the draw bar 66 draws the sponge head 60 between the roller segments 58 and the cylindrical base 115 to wring the sponge head as illustrated in FIG. *7b*. The frictional force between the cylindrical base 15 and the sponge head 60 causes the cylindrical base to rotate. In this way, pivoting the wringer lever 70 to the wringing position causes the sponge head to be retracted between the roller segments and the wiper 110 to be extended. Similarly, pivoting the wringer lever 70 to the cleaning position causes the sponge head 60 to be extended from between the roller segments 58 and the wiper 110 to be retracted.

Some of the many novel features and advantages of the present invention are now apparent in view of the foregoing description. For example, a wiper has been described that is removably mountable upon a wringer mop that utilizes cylindrical rollers. The means for mounting the wiper on the wringer mop are configured to accommodate rollers of varying diameter. In this way, the wiper can be used with many of the wringer mops that are currently in use. Additionally, because of the design of the mounting means, the wringer mop is still operable to wring the sponge while the wiper is mounted upon the mop.

While particular embodiments of the present invention have been herein illustrated and described, it is not intended to limit the invention to such disclosures, but changes and modifications may be made therein and thereto within the scope of the following claims.

That which is claimed is:

1. A wiper operable to be removably mounted upon a wringer mop having an elongated handle and two cylindrical roller elements for wringing a sponge head, wherein said wiper comprises:

a body having a surface adapted to confront said roller elements;

a wiper blade connected to said body; and a roller clamp comprising a pair of parallel sides projecting from said surface of said body, said sides spaced from one another forming a saddle for receiving one of the roller elements of the wringer mop, wherein said sides project from said body a height at least as great as the radius of the one cylindrical roller element, and the distance between said sides correlates to the diameter of the one roller element.

2. The wiper of claim 1, wherein each of said sides further comprises a flexible gripper portion, wherein said gripper portions oppose one another and angle toward one another remote from said surface so that the distance between said gripper portions is less than the distance between said sides adjacent said surface of said body.

3. The wiper of claim 1, further comprising a second roller clamp aligned with said first roller clamp axially of the one roller element.

4. The wiper of claim 1, wherein said wiper blade comprises a generally flat resilient flexible strip disposed parallel to said sides of said roller clamp.

5. The wiper of claim 1, further comprising a pole connector on said body adapted to be removably connected with the elongated handle to anchor said body on the wringer mop.

6. The wiper of claim 1, wherein said body further comprises a wiper support forming an angle with the surface of said body, wherein said wiper blade comprises a generally flat resilient flexible strip connected to said wiper support, so that said wiper blade is at an angle to the surface of said body.

7. A wiper operable to be removably mounted upon a wringer mop having an elongated handle and two cylindrical roller elements for wringing a sponge head, wherein said wiper comprises:

a body having a surface adapted to confront said roller elements;

a wiper blade connected to said body;

a pair of longitudinally aligned roller clamps, each of said roller clamps comprising a pair of parallel sides projecting from said surface of said body, said sides spaced from, one another forming a saddle for receiving one of the roller elements of the wringer mop; and a pole connector adapted for connecting said body to the elongated handle.

8. The wiper of claim 7, wherein said sides of said roller clamps project from said body a height at least as great as the radius of the one cylindrical roller element, and the distance between said sides correlates to the diameter of the one cylindrical roller element.

9. The wiper of claim 7, wherein each of said sides further comprises a flexible gripper portion, wherein said gripper portions oppose one another and angle toward one another so that the distance between said gripper portions remote from said surface is less than the distance between said sides adjacent said surface of said body.

10. The wiper of claim 7, wherein said wiper blade comprises generally a flat resilient flexible strip disposed parallel to said sides of said roller clamps.

11. A wringer mop with wiper comprising:

an elongated handle;

a mop head connected to said handle comprising two parallel axles spaced apart from one another and cylindrical roller elements rotatably mounted upon said axles;

a sponge head comprising a sponge and a sponge bracket connected to said sponge;

a draw bar extending from said mop head and connectable with said sponge bracket, so that displacement of said draw bar in one direction draws said sponge head through said roller elements to wring the sponge; and a wiper connected to said mop head, comprising:

a body having a surface adapted to confront said roller elements;

a wiper blade connected to said body; and a roller clamp comprising a pair of parallel sides projecting from said surface of said body, said sides spaced from one another forming a saddle for receiving one of the roller elements of the wringer mop, wherein said sides project from said body a height at least as great as the radius of the one cylindrical roller element, and the distance between said sides correlates to the diameter of the one roller element.

12. The wiper of claim 11, wherein each of said sides further comprises a flexible gripper portion, wherein said gripper portions oppose one another and angle toward one another so that the distance between said gripper portions remote from said surface is less than the distance between said sides adjacent said surface of said body.

13. The wiper of claim 11, further comprising a second roller clamp aligned with said first roller clamp axially of the one roller element.

14. The wiper of claim 11, wherein said wiper blade comprises generally a flat resilient flexible strip disposed parallel to said sides of said roller clamp.

15. The wiper of claim 11, further comprising a pole connector on said body adapted to be removably connected with the elongated handle to anchor said body on the wringer mop.

16. The wiper of claim 11, wherein said body further comprises a wiper support forming an angle with the surface of said body, wherein said wiper blade comprises generally a flat resilient flexible strip connected to said wiper support, so that said wiper blade is at an angle to the surface of said body.

17. A wringer mop comprising:

an elongated handle;

an actuator pivotally connected to said handle, operable between a first and second position;

a mop head connected to a distal end of said handle, comprising:

a sponge head;

two generally parallel spaced-apart axles; and a plurality of roller segments rotatably mounted on said axles, forming two generally parallel rows of roller segments;

a wiper pivotable between a retracted position and an extended position comprising:

a cylindrical base rotatably mounted on one side of said axles confronting said sponge head;

two spaced-apart arms, projecting from said cylindrical base;

a wiper blade holder having two generally parallel elongated sides, one of said sides connecting said two arms; and an elongated flexible wiper blade fixedly connected to said wiper blade holder so that said wiper blade projects from the second of said two elongated sides;

wherein operation of said actuator from said first position to said second position displaces said sponge head relative to said cylindrical base causing said cylindrical base to rotate, thereby pivoting said wiper into said extended position.

18. A wiper operable to be pivotally mounted upon a wringer mop having an elongated handle, an actuator connected to said handle operable between a first and second position, and a mop head including a sponge head, two generally parallel spaced-apart axles, and a plurality of roller segments rotatably mounted on said axles, forming two parallel rows of roller segments, said wiper comprising:

a cylindrical base rotatably mounted on one side of said axles, confronting the sponge head of the mop;

two parallel spaced-apart arms, projecting from said cylindrical base;

an elongated wiper blade holder connecting said two arms;

an elongated flexible wiper blade fixedly connected to said wiper blade holder, said wiper blade being substantially the same length as said wiper blade holder;

wherein operation of said actuator from said first position to said second position displaces said sponge head relative to said cylindrical base causing said cylindrical base to rotate thereby pivoting said wiper.

* * * * *